US006955564B2

(12) United States Patent
Cho et al.

(10) Patent No.: US 6,955,564 B2
(45) Date of Patent: Oct. 18, 2005

(54) DIFFERENTIAL PAIR INTERCONNECTION APPARATUS

(75) Inventors: In Kui Cho, Daejon-Shi (KR); Keun Byoung Yoon, Daejon-Shi (KR); Seung Ho Ahn, Daejon-Shi (KR); Sang Pil Han, Daejon-Shi (KR); Myung Yung Jeong, Daejon-Shi (KR)

(73) Assignee: Electronics and Telecommunications Research Institute, Daejon-Shi (KR)

( * ) Notice: Subject to any disclaimer, the term of this patent is extended or adjusted under 35 U.S.C. 154(b) by 37 days.

(21) Appl. No.: 10/786,598

(22) Filed: Feb. 26, 2004

(65) Prior Publication Data

US 2005/0090147 A1 Apr. 28, 2005

(30) Foreign Application Priority Data

Oct. 24, 2003 (KR) ..... 10-2003-0074777

(51) Int. Cl.[7] ..... H01R 9/05

(52) U.S. Cl. ..... 439/581; 333/97

(58) Field of Search ..... 439/63, 581, 79; 333/97

(56) References Cited

U.S. PATENT DOCUMENTS

| | | | | |
|---|---|---|---|---|
| 3,750,053 A | * | 7/1973 | LeDonne | 333/105 |
| 6,270,381 B1 | | 8/2001 | Adriaenssens et al. | |
| 6,293,827 B1 | | 9/2001 | Stokoe et al. | |
| 6,551,140 B2 | | 4/2003 | Billman et al. | |

* cited by examiner

*Primary Examiner*—Phuong Dinh
(74) *Attorney, Agent, or Firm*—Mayer, Brown, Rowe & Maw LLP

(57) ABSTRACT

Provided is a differential pair interconnection apparatus for providing a differential signal on a printed circuit board having signal paths for high-speed differential signals to an external circuit and providing a signal inputted from the external circuit to the printed circuit board without any signal distortion. According to the differential pair interconnection apparatus of the present invention, there can be provided two separate physical channels without impedance mismatching.

6 Claims, 3 Drawing Sheets

DIFFERENTIAL PAIR INTERCONNECTION APPARATUS

BACKGROUND

1. Field of the Invention

The present invention relates to an interconnection structure for a high-speed electrical interconnection between a differential transmission line and a single-ended line and, more particularly, to a differential pair interconnection apparatus for providing differential signals on a printed circuit board (PCB) having signal paths for high-speed differential signals to an external circuit, or for providing signals inputted from the external circuit to the printed circuit board, without any signal distortion.

2. Discussion of Related Art

As technology advances, various types of integrated circuits (ICs) have been developed, and thus, an operating speed of the ICs has been also gradually increased. Recently, an IC capable of transmitting data with a data transfer rate in the range of 5 to 10 Gbps, or more, has been developed. However, in spite of such a technology, the data transfer rate may be limited by various factors, which may be generated in a signal transmission path. As for the major factors that confine the data transfer rate, there may be impedance mismatching and cross talk. Accordingly, as one method for solving such problems, a differential signal line operating by means of differential signals has been introduced. The differential signal line is comprised of two conductive paths located adjacent to each other, and the signals thereof are processed with a voltage difference between the two conductive paths. Since the two conductive paths have the same amount of electrical noises that may electromagnetically affect the differential signal line, common noise voltages generated in the two conductive paths does not affect the signals. Therefore, the differential signal line is less sensitive to cross talk than the single-ended signal line.

However, despite of employing the differential signal line, discontinuity and impedance mismatching in various interconnection structures have influenced on the signal transmission. In a general interconnection structure which transmits signals from one circuit board to the other circuit board or module, if a signal frequency increases, various problems may be occurred such as increases of parasitic components, impedance mismatching and so on. As one of representative conventional technologies related to the interconnection structure, there has been PCT Patent Publication No. WO2001/39332 (by TERADYNE Inc., published May 31, 2001). This International Patent provides a modular electrical connector that provides signal paths for differential signals between a motherboard and a daughter board or other electrical components. The electrical connector transmits a plurality of differential signals and includes a plurality of pair signal conductors with two signal paths, and the plurality of pair signal conductors may control cross talk by operating with a differential mode. Accordingly, the modular electrical connector is attached to a printed circuit board such as a motherboard, daughter board, or backplane, and has a configuration including differential signal lines on the printed circuit board.

As another interconnection structure, there has been a high speed and density interconnection system for differential and single-ended transmission applications designed by NORTHROP GRUMMAN CORPORATION (U.S. Provisional Patent Application Ser. No. 60/328,396, filed Oct. 12, 2001). The high density interconnect system has a configuration including a built-in coaxial cable that contains two inner conducting wires rather than one, and the two inner conducting wires provide two physical channels. This system has a latching mechanism for compression mount type electrical connectors, and provides a high speed and density electrical connector having a central twinax or coax portion and fuzz button contacts on opposite ends of the central twinax or coax portion.

As still another interconnection structure, there is a connector for interconnection between a strip line and a coaxial cable, provided by HEWLETT PACKARD Co. (U.S. Pat. No. 5,404,117, issued on Apr. 4, 1995). The patent provides an optimal configuration in a transition area so as to minimize a reflection problem and signal distortion in the transition area, which may be caused by signal transition from the coax cable to the strip line. If a frequency of a transited signal reaches several GHz or more and a signal rising time (tr) becomes pico-seconds, the signal is greatly distorted in an abrupt transition area. Accordingly, to solve this problem, a configuration having a cosine form has been proposed.

FIG. 1 shows an interconnection structure of conventional single-ended lines and SMA connectors.

Differential signal lines 101*a* and 101*b* are formed on a printed circuit board (PCB) 100 so as to transmit signals with no changes in differential impedance. The differential signal lines 101*a* and 101*b* are connected to SMA connectors 201*a* and 201*b*, respectively, for an interconnection with the general single-ended signal lines connected to an external circuit and an apparatus. The SMA connectors 201*a* and 201*b* are supported and fixed on the circuit board 100 by housings 202*a* and 202*b*, respectively, and central pins 203*a* and 203*b* are connected to the differential signal lines 101*a* and 101*b* on the circuit board 100 through the housings 202*a* and 202*b*.

The differential signal lines 101*a* and 101*b* should be placed closer each other for an interaction. However, since the aforementioned configuration does not have an enough space to interconnect with the SMA connectors 201*a* and 201*b*, the differential signal lines 101*a* and 101*b* must inevitably be separated by a predetermined distance or more, in order to interconnect the differential signal lines 101*a* and 101*b* to the SMA connectors 201*a* and 201*b*, whereby a bending of the differential signal lines 101*a* and 101*b* comes to be required. An isolation of the differential signal lines 101*a* and 101*b* causes a weakening of a cohesive force between signals, and thus, the signals are transmitted from a differential mode to the single-ended mode and also benefits obtained by the differential signal lines 101*a* and 101*b* cannot be retained anymore due to bending areas 102 and 103. Therefore, in order to minimize an influence caused by line widths or bending of the differential signal lines 101*a* and 101*b*, chamfered bend configurations 102 and 103, which cut certain areas of the differential signal lines 101*a* and 10*b* may be formed. However, in spite of such efforts, the differential signal lines 101*a* and 101*b* operate with the single-ended mode, so that discontinuity or impedance may occur. As a result, distortion of the signals occurs. Thus, for this reason, it is difficult to design and manufacture an interconnection apparatus capable of transmitting signals at a high speed of 5 Gbps or more.

SUMMARY OF THE INVENTION

Accordingly, the present invention is directed to a differential pair interconnection apparatus capable of solving the above-mentioned drawbacks, by making use of a coaxial type Y-branch configuration in which a mutual coupling does not occur, whereby a differential signal line may be formed on a printed circuit board (PCB) in parallel.

One of the present invention is to provide a differential pair interconnection apparatus for transmitting a signal through a differential signal line formed on a circuit board to an external circuit, or transmitting the signal from the external circuit to the circuit board, comprising of: a pair of coaxial type cables being arranged in a Y-branch form and including one end portions being spaced apart from each other and the other end portions placed close to each other, wherein said each of the end portions being spaced apart from each other being connected to a connector and each of the end portions placed close to each other having an internal conductor exposed outside; and a housing in which internal conductors of the coaxial type cables are inserted therein, respectively, to be protruded outward, and a plurality of fixing means are formed on the side of the housing having the protruded internal conductors, wherein the circuit board is combined between the fixing means of the housing so that the differential signal line of the circuit board is contacted to the internal conductors of the coaxial type cables.

Here, the connector and the housing are made of conductive materials, and connected to a ground in common. In addition, the fixing means are formed in a rectangular parallelepiped shape, and the coaxial type cables have impedance matched to be equal to the impedance of a single-ended signal line.

In a preferred embodiment of the present invention, a protecting cover for protecting and supporting the exposed portion of the coaxial type cable may be further included.

BRIEF DESCRIPTION OF THE DRAWINGS

The above and other objectives, features and advantages of the present invention will be more apparent from the following detailed description taken in conjunction with the accompanying drawings, in which.

DETAILED DESCRIPTION OF PREFERRED EMBODIMENTS

As a transmission rate is increased, a transmission line using not electrical circuits but radio frequency (RF) should be introduced. A differential signal line for processing and transmitting high-speed signals is very efficient in terms of interference between signal lines and signal integrity. If semiconductor chips are developed more and a transmission speed accommodated in one channel further increases, the differential signal line will be widely used. However, in case where the differential signal line is employed, in general, signal distortion and transmission impairment will be generated due to discontinuity of the signal line caused by an interconnection from a board to an external circuit or between the boards. Therefore, the present invention provides the differential pair interconnection apparatus for providing differential signals on a printed circuit board (PCB) having signal paths for high-speed differential signals to an external circuit, or for providing signals inputted from the external circuit to the printed circuit board, without any signal distortion.

Hereinafter, the present invention will be described with reference to the accompanying drawings.

Figure 1:
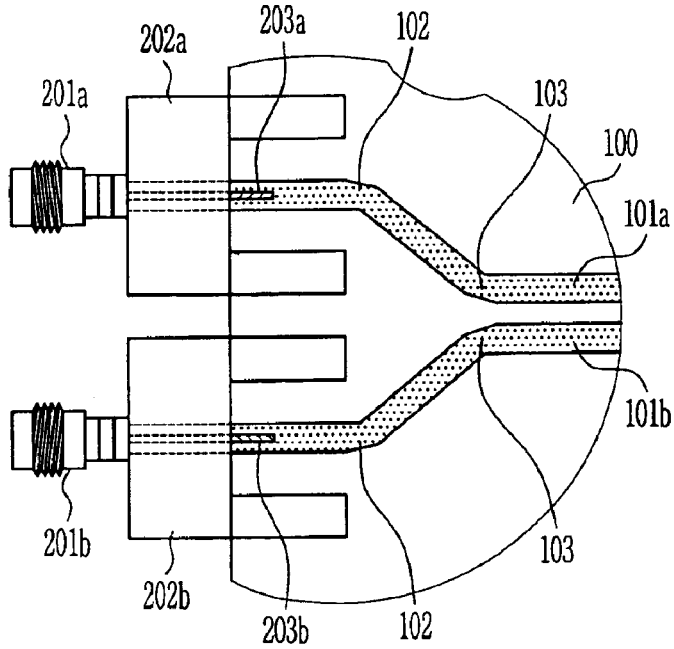
FIG. 1 (PRIOR ART)
FIG. 1 is a plan view for explaining an interconnection structure of conventional single-ended lines and SMA connectors.
Figure 2:
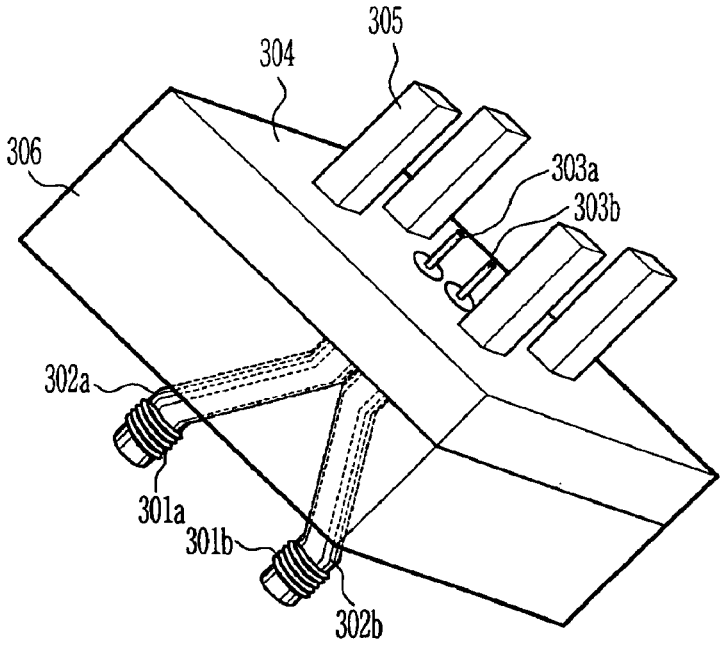
FIG. 2 is a perspective view showing an entire configuration of a differential pair interconnection apparatus according to the present invention.

FIG. 2 illustrates an entire configuration of a differential pair interconnection apparatus according to the present invention.

The differential pair interconnection apparatus of the present invention is composed of two sections: a pair of coaxial type cables 302*a* and 302*b*, and a housing 304, wherein the pair of coaxial type cables includes an external conductor 312*a*, internal conductors 303*a* and 303*b*, and a dielectric 312*c*, and the housing 304 accommodates the coaxial type cables 302*a* and 302*b*.

The coaxial type cables 302*a* and 302*b* are arranged in a Y-branch shape. The coaxial type cables 302*a* and 302*b* have one end portions placed closer to each other and the other end portions spaced further apart from each other. In the end portions placed closer to each other, the dielectric 312*c* and the external conductor 312*a* are removed to partially expose the internal conductors 303*a* and 303*b* of the coaxial type cables. The internal conductors 303*a* and 303*b* are inserted into one side of the housing 304 and protruded from the other side of the housing 304. The end portions spaced further apart from each other of the coaxial type cables 302*a* and 302*b* are connected with SMA connectors 301*a* and 301*b* formed in a female screw shape to be easily connected to an SMA connector (not shown) coupled with a general single-ended line. The coaxial type cables 302*a* and 302*b* are signal lines composed of the external conductor 312*a*, the internal conductors 303*a* and 303*b*, and the dielectric 312*c*, wherein the circular internal conductors 303*a* and 303*b* are surrounded with the cylindrical external conductor 312*a*. The dielectric 312*c* having a specified dielectric constant of an impedance value, e.g., 50Ω fills between the internal conductors 303*a* and 303*b* and the external conductor 312*a*.

The housing 304 is made of conductive materials, and a plurality of fixing means 305 are formed on the side of the housing having the protruded internal conductors 303*a* and 303*b*. The fixing means 305 is formed in, e.g., a rectangular parallelepiped shape, and four fixing means 305 are disposed with a symmetry structure. Further, a protecting cover 306 can be formed in a conductive or insulating material on another side of the housing 304 so as to protect and support the exposed portions of the coaxial type cables 302*a* and 302*b* connected with the SMA connectors 301*a* and 301*b*.

Figure 3:
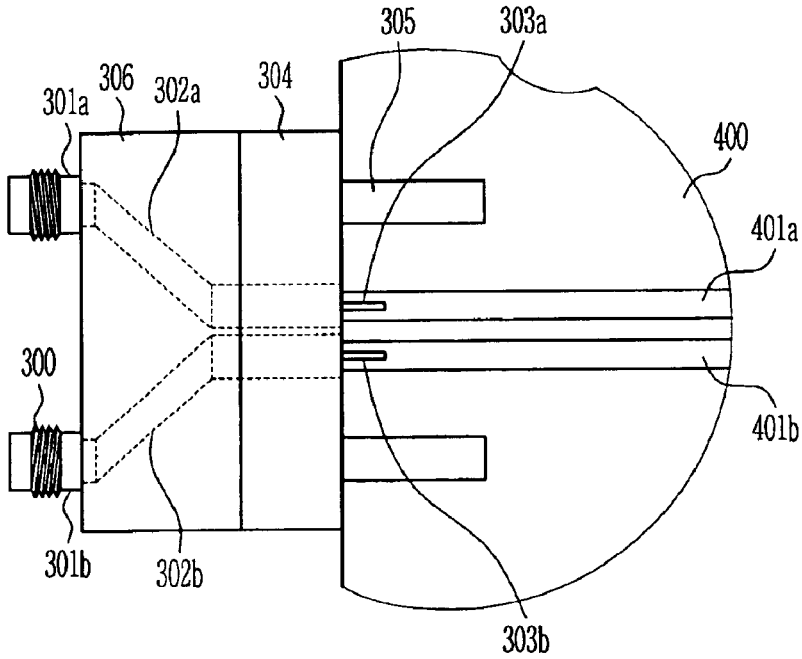
FIG. 3 is a plan view showing a circuit board interconnected to a differential pair interconnection apparatus according to the present invention.
Figure 4:
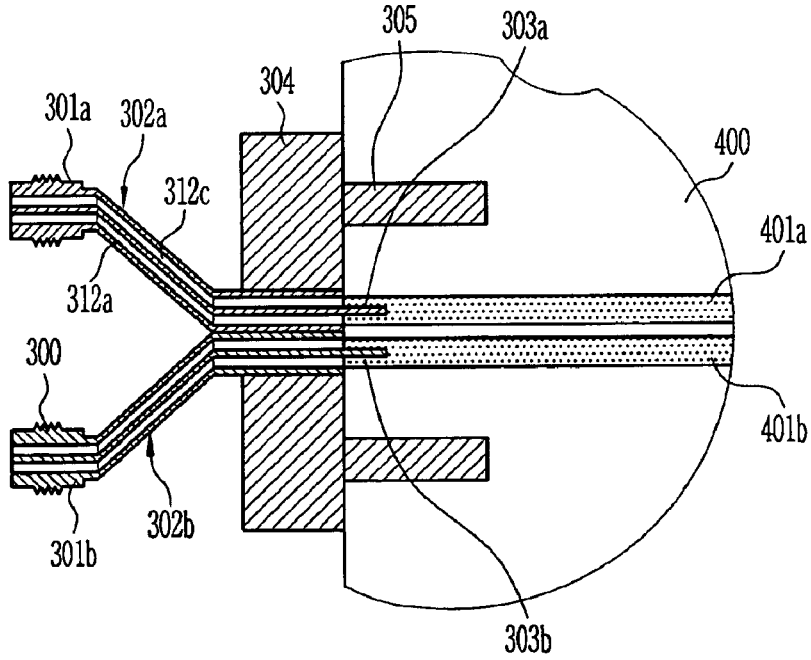
FIG. 4 is a sectional view of upper portion in a differential pair interconnection apparatus according to the present invention.

FIG. 3 and FIG. 4 illustrate the configuration of the differential pair interconnection apparatus connected to the circuit board having the differential signal lines.

The circuit board 400 is combined between the fixing means 305, for the purpose of contacting the differential signal lines 401*a* and 401*b* of the circuit board 400 with the internal conductors 303*a* and 303*b* of the coaxial type cables 302*a* and 302*b*.

Figure 5:
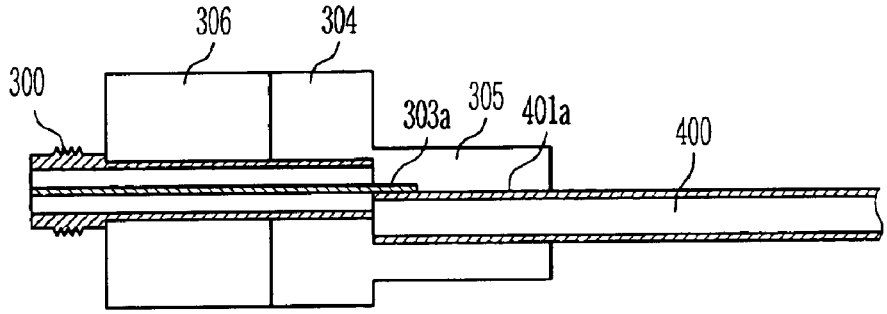
FIG. 5 is a longitudinal sectional view of a differential pair interconnection apparatus according to the present invention.

FIG. 5 is a longitudinal sectional view of a differential pair interconnection apparatus according to the present invention.

Referring to FIG. 5, in order to retain benefits of the differential signal lines serving as complementary component for signals by the same contact structure when connecting the circuit board 400, the internal conductors 303*a* and 303*b* and the differential signal lines 401*a* and 401*b* have to contact with extremely closed to each other. In this case, since the contact sides of the internal conductors 303*a* and 303*b* are areas operating in a differential mode, it is advantageous to make to have the same condition to the maximum extent.

Figure 6:
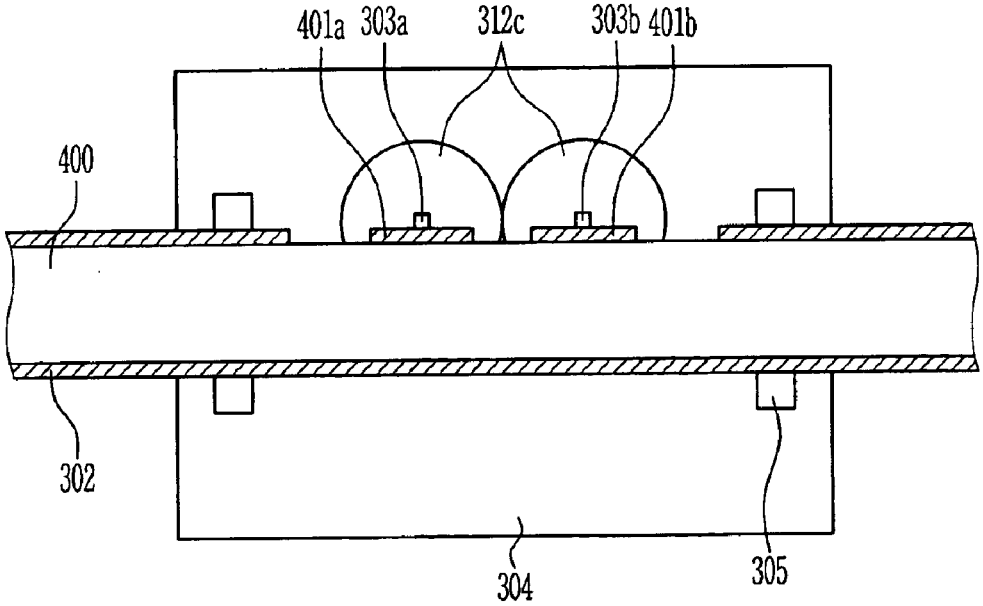
FIG. 6 is a detail view showing an interconnecting portion between a differential pair interconnection apparatus and a circuit board according to the present invention.

FIG. 6 is a detail view showing portions for interconnecting a differential pair interconnection apparatus and a circuit board according to the present invention. In FIG. 6, the fixing means 305 for supporting and fixing the circuit board 400 and the external conductor 312*a* of the coaxial type cables 302*a* and 302*b* are connected to the ground of the circuit board 400, and female screw lines 300 of the SMA connectors 301*a* and 301*b* and the housing 304 are both connected to the common ground.

In the differential pair interconnection apparatus of the present invention configured in such a manner, the impedance of the coaxial type cables 302*a* and 302*b* is determined by the dielectric constant of the dielectric 312*c* and the size of the external conductor 312*a* and the internal conductors 303*a* and 303*b*. In the present invention, the impedance value is matched to an impedance value, e.g., 50Ω in the single-ended signal line. In this case, the impedance matching is implemented by the impedance up to the ends of the protruded internal conductors 303*a* and 303*b* connected to the differential signal lines 401*a* and 401*b* of the circuit board 400. The differential pair interconnection apparatus configured as described above may electrically operate with the impedance value, for example, 50Ω in the single-ended.

The differential signal lines of the circuit board are designed and formed to be capable of transmitting high-speed data signals without any signal interference and distortion, and transmit to an external apparatus or receive from the external apparatus. When differential signals are transmitted to the external apparatus or received from the external apparatus, the coaxial cable and SMA connector of single-ended lines are generally used. However, in this case, in the process of transferring signals from the circuit board to the SMA connector, serious discontinuity of signals occurs, and then reflection of the signal may happen. To solve such problems, the present invention proposes the differential pair interconnection apparatus configured as shown in FIG. 2. The present invention is implemented by basic concepts that the discontinuity of a single mode operation area caused by an interconnection between the differential signal lines and the internal conductors of the SMA connector are transferred to a differential mode area. When the identical discontinuities are generated between two connected differential lines, the discontinuity of the differential mode, unlike the discontinuity of the single mode, can connect differential mode impedances by an interconnection of the identical discontinuities without any discontinuity. In other words, the differential signal lines are designed to be parallel to a printed circuit board by making use of a coaxial type Y-branch configuration capable of keeping the impedance unchangeable without occurring a mutual coupling, and thus it is possible to protect distortion of the signals caused by the discontinuity or impedance mismatching.

So far, for an interconnection with the SMA connector, it has been required to form a differential signal line having a bending area in the circuit board. Since the design of the bending area becomes harder as the frequency of the signal is higher, the prior art has difficulties of designing and manufacturing the interconnection apparatus capable of transmitting at high-speed signals of 5 Gbps or more. The differential pair interconnection apparatus of the present invention allows the differential signal lines of the printed circuit board to be formed parallel with the printed circuit board without any bending areas, thereby it is possible to solve the transformation and distortion that may be caused in the process of the signal input or output. The present invention provides the differential pair interconnection apparatus useful to signal transmission in a module or a printed circuit board having high-speed signal lines; and it can be widely used in measurement technical fields.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A differential pair interconnection apparatus for transmitting a signal through a differential signal line formed on a circuit board to an external circuit, or transmitting the signal from the external circuit to the circuit board, comprising of:

a pair of coaxial type cables being arranged in a Y-branch form and including one end portions being spaced apart from each other and the other end portions placed close to each other, wherein said each of the end portions being spaced apart from each other being connected to a connector and each of the end portions placed close to each other having an internal conductor exposed outside; and a housing in which internal conductors of the coaxial type cables are inserted therein, respectively, to be protruded outward, and a plurality of fixing means are formed on the side of the housing having the protruded internal conductors, wherein the circuit board is combined between the fixing means of the housing so that the differential signal line of the circuit board is contacted to the internal conductors of the coaxial type cables.

2. The differential pair interconnection apparatus of claim 1, wherein the connector and the housing are made of conductive materials.

3. The differential pair interconnection apparatus of claim 1, wherein the connector and the housing are connected to a ground in common.

4. The differential pair interconnection apparatus of claim 1, wherein the fixing means are formed in a rectangular parallelepiped shape.

5. The differential pair interconnection apparatus of claim 1, wherein the coaxial type cables have impedance matched to be equal to the impedance of a single-ended signal line.

6. The differential pair interconnection apparatus of claim 1, further comprising of a protecting cover for protecting and supporting the exposed portion of the coaxial type cable.

* * * * *